US012590495B2

(12) United States Patent
Samuel et al.

(10) Patent No.: US 12,590,495 B2
(45) Date of Patent: Mar. 31, 2026

(54) RETROFITTING EXISTING RIG HARDWARE AND PERFORMING BIT FORENSIC FOR DULL BIT GRADING THROUGH SOFTWARE

(71) Applicant: Landmark Graphics Corporation, Houston, TX (US)

(72) Inventors: Robello Samuel, Houston, TX (US); Nagaraj Srinivasan, Houston, TX (US)

(73) Assignee: Landmark Graphics Corporation, Houston, TX (US)

( * ) Notice: Subject to any disclaimer, the term of this patent is extended or adjusted under 35 U.S.C. 154(b) by 0 days.

(21) Appl. No.: 18/847,607

(22) PCT Filed: Nov. 23, 2022

(86) PCT No.: PCT/US2022/050960

§ 371 (c)(1),
(2) Date: Sep. 16, 2024

(87) PCT Pub. No.: WO2023/204852

PCT Pub. Date: Oct. 26, 2023

(65) Prior Publication Data

US 2025/0230715 A1 Jul. 17, 2025

Related U.S. Application Data

(60) Provisional application No. 63/332,872, filed on Apr. 20, 2022.

(51) Int. Cl.
*E21B 12/02* (2006.01)
*E21B 41/00* (2006.01)

(52) U.S. Cl.
CPC ..... *E21B 12/02* (2013.01); *E21B 2200/20* (2020.05)

(58) Field of Classification Search
CPC ..... G06T 2207/30164; E21B 2200/20; E21B 10/42; E21B 10/00; E21B 12/02; E21B 17/006; E21B 41/00; E21B 12/06
See application file for complete search history.

(56) References Cited

U.S. PATENT DOCUMENTS

2020/0149354 A1 5/2020 Singh et al.
2020/0190963 A1* 6/2020 Gooneratne ..... G01N 21/8851
(Continued)

*Primary Examiner* — Kipp C Wallace
(74) *Attorney, Agent, or Firm* — Michael Jenney; Parker Justiss, P.C.

(57) ABSTRACT

The disclosure provides an automated process for determining the wear condition of a downhole tool that removes the subjectivity associated with manual observation. The automated process can advantageously evaluate a wear condition of a downhole tool using visual analytics and real-time analysis after the downhole tool has been extracted from the wellbore. An example of a method includes: (1) securing a downhole tool in a rig assembly, (2) obtaining, using sensors, surround tool data of the downhole tool in the rig assembly, wherein the surround tool data includes a first set of surround tool data obtained before a downhole operation by the downhole tool and a second set of surround tool data obtained after the downhole operation, and (3) automatically determining a wear condition of the downhole tool in real time by comparing the second set of surround tool data to the first set of surround tool data.

19 Claims, 4 Drawing Sheets

(56) References Cited

U.S. PATENT DOCUMENTS

| | | | | |
|---|---|---|---|---|
| 2020/0224524 | A1 | 7/2020 | Parmeshwar et al. | |
| 2021/0174486 | A1 | 6/2021 | Chowhan | |
| 2021/0358100 | A1 | 11/2021 | Lyles et al. | |
| 2021/0363833 | A1 | 11/2021 | Potash | |
| 2023/0184041 | A1* | 6/2023 | Lyles | G06F 18/24<br>702/34 |
| 2023/0193741 | A1* | 6/2023 | Annaiyappa | E21B 44/04 |
| 2024/0242326 | A1* | 7/2024 | Chowhan | G06T 7/521 |

* cited by examiner

RETROFITTING EXISTING RIG HARDWARE AND PERFORMING BIT FORENSIC FOR DULL BIT GRADING THROUGH SOFTWARE

CROSS-REFERENCE TO RELATED APPLICATION

This application is the National Stage of, and therefore claims the benefit of International Application No. PCT/US2022/050960 filed on Nov. 23, 2022, entitled "RETROFITTING EXISTING RIG HARDWARE AND PERFORMING BIT FORENSIC FOR DULL BIT GRADING THROUGH SOFTWARE," which claims the benefit of U.S. Provisional Application Ser. No. 63/332,872 by Robello Samuel, et al. on Apr. 20, 2022, entitled "RETROFITTING EXISTING RIG HARDWARE AND PERFORMING BIT FORENSIC FOR DULL BIT GRADING THROUGH SOFTWARE," both of which are commonly assigned with this application and incorporated herein by reference in their entirety.

TECHNICAL FIELD

The disclosure generally relates to wellbore drilling and more particularly, to visual analytics and real-time analysis for causation and correction of wear on downhole tools, such as drill bit wear resulting from wellbore drilling.

BACKGROUND

A drill bit is located at the bottom of a drill string and suffers the impact of the formation while drilling and cutting. As such, the drill bit gets worn out as the drilling progresses. To check the condition, the drill bit is typically removed from the wellbore and the wear pattern of the drill bit is observed and graded. This grading, known as dull bit grading, is per the standards set by International Association of Drilling Contractors (IADC). The first two numbers of the dull bit grading indicate the level of degradation with 0 being no wear and 8 being completely worn out.

BRIEF DESCRIPTION

Reference is now made to the following descriptions taken in conjunction with the accompanying drawings, in which.

DETAILED DESCRIPTION

Figure 1:
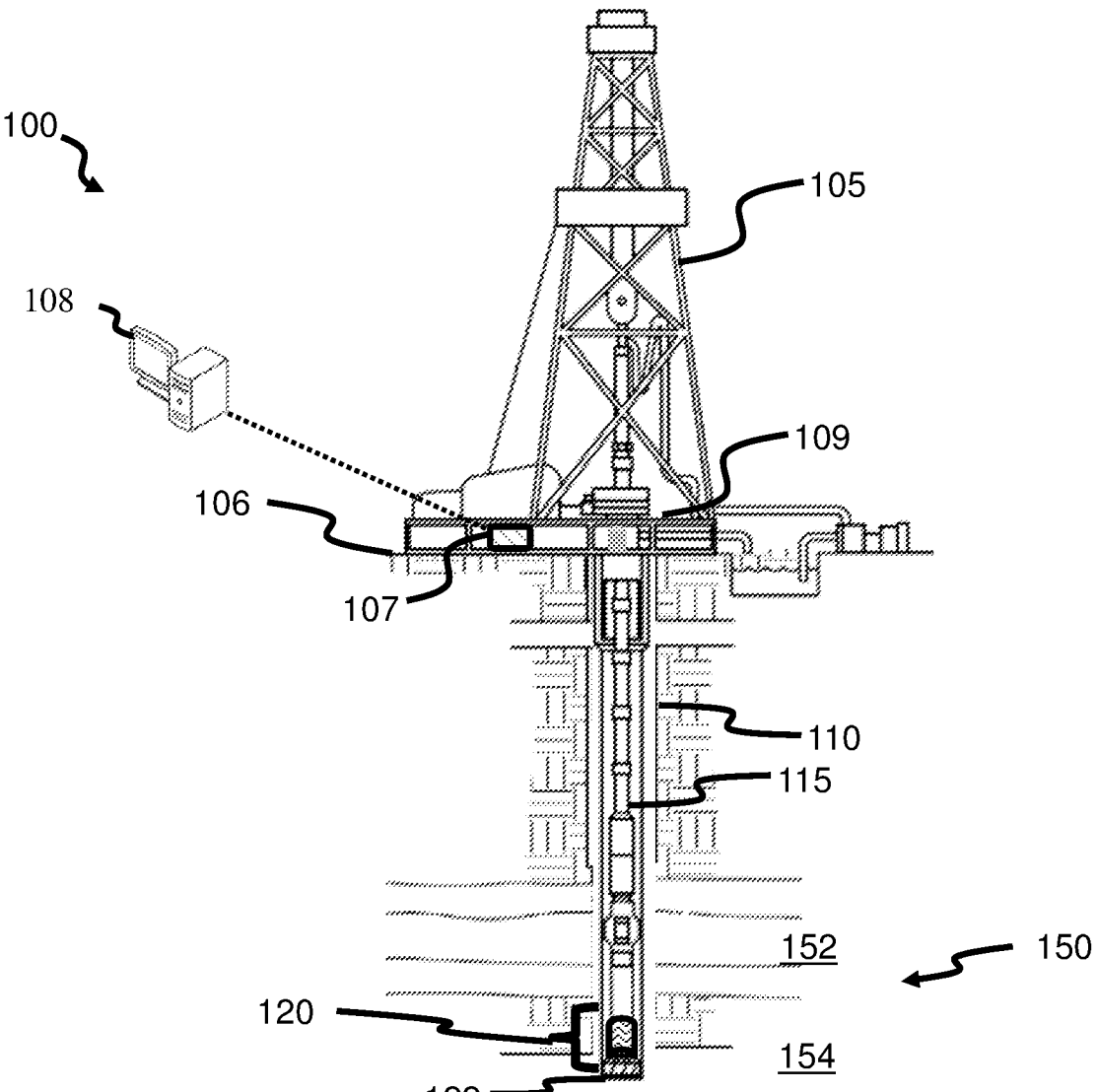
FIG. 1 is an illustration of a diagram of an example well system that can evaluate properties of a downhole tool according to the principles of the disclosure.

Though there are guidelines, the visual observation and manual grading of the drill bit is subjective and can vary depending on the grader. Additionally, the grading process can take time and delay a decision regarding replacing or continuing to use the graded drill bit. Accordingly, an improved process for grading drill bits is needed in the industry.

The disclosure provides an automated process for determining the wear condition of a downhole tool that removes the subjectivity associated with manual observation. The automated process advantageously evaluates a wear condition of a downhole tool using visual analytics and real-time analysis after the downhole tool has been extracted from the wellbore. Using such analytics and real-time analysis, possible causes of the wear condition can also be determined.

The automated process uses tool data of the downhole tool obtained by sensors and performs real time analysis of the tool data to determine the wear condition. The tool data includes a first set of tool data obtained before a downhole operation of the downhole tool and a second set of tool data obtained after the downhole operation. The wear condition is determined by comparing the second set of tool data to the first set of tool data. The tool data can be surround tool data that provides a rotational, or surround, view of sensor data around the downhole tool, such as a 360 degree view. The downhole tool can be, for example, a drill bit and the automated process can evaluate or grade wear or dullness of the drill bit using visual analytics and real-time analysis after the bit is pulled. The wear condition of the drill bit can be correlated or mapped to an existing standard, such as dull bit grading. The downhole tool can be another tool beside a drill bit, such as, mud motors, stablizers, reamers, hole openers, etc. and can include other downhole devices such as tubing. Accordingly, tubular thread connections can be check according to the principles of the disclosure.

Sensors for gathering the tool data can be attached to a rig assembly that holds or secures the downhole tool at the surface, such as on a drilling rig deck. The rig assembly can be, for example, a bit breaker, a mud box, a mud bucket, or another type of tool container used to secure a downhole tool at the surface. Accordingly, a new apparatus is also disclosed that includes the rig assembly, sensors, and at least one processor configured to automatically determine a wear condition of a downhole tool in real time using tool data obtained by the sensors. The apparatus can also include a wash system to clean the downhole tool after being pulled and a transmitter that sends the wear condition and/or other analytic information to a well operating system for use or further analysis. As noted, the tool data can be surround tool data.

More than one type of sensor can be used to obtain the tool data. The different type of sensors can include image sensors, electromagnetic sensors, lasers, sonic sensors, and thermal sensors. The image sensors can be one or more video cameras. A combination of the different types of sensors can simultaneously gather the tool data. The sensors can be stationary or can rotate around the downhole tool to gather surround tool data. The one or more processors can process the combination of tool data from the different sensors to determine the wear condition or for other analysis, such as causes of the wear. The processing of the combination of tool data can be simultaneous. One or more of the sensors or different type of sensors can be attached to the downhole tool or can be located downhole. As such, a combination of sensors can be used to gather tool data.

The one or more processors can be directed by a series of operating instructions corresponding to an algorithm that determines the wear condition based on the tool data. The operating instructions can be stored on a non-transitory computer readable medium. The algorithm can analyze the tool data using functionalities from conventional software, such as facial recognition software, for processing visual data from image sensors. At least a portion of the analysis can be performed using video analytics and machine learning. Visual data from multiple cameras can be stitched together to create a 360 view for analysis. The algorithm can use the visual analytics with physics models related to tool data from other sensors for processing. The physics models can be used to check and learn downhole conditions stand after stand for a given depth in the wellbore.

FIG. 1 is an illustration of a diagram of an example well system 100 that can evaluate properties of a downhole tool according to the principles of the disclosure. The well system 100 can be, for example, a logging while drilling (LWD) system, a measuring while drilling (MWD) system, a seismic while drilling (SWD) system, a telemetry while drilling (TWD) system, an injection well system, an extraction well system, or another type of borehole system. Well system 100 includes a derrick 105, a well site controller 107, and a computing system 108. Well site controller 107 includes a processor and a memory and is configured to direct operation of well system 100. Derrick 105 is located at a surface 106. For FIG. 1, drill bit 122 will be used as an example of a downhole tool in which a wear condition is determined.

Extending below derrick 105 is a wellbore 110 with downhole tools 120 at the end of a drill string 115. Downhole tools 120 can include various downhole tools, such as a formation tester or a bottom hole assembly (BHA). At the bottom of downhole tools 120 is drill bit 122. Other components of downhole tools 120 can be present, such as a local power supply (e.g., generators, batteries, or capacitors), telemetry systems, sensors, transceivers, and control systems. Wellbore 110 is surrounded by subterranean formations 150, including subterranean formations 152 and 154.

Well site controller 107 or computing system 108, which can be communicatively coupled to well site controller 107, can be utilized to communicate with downhole tools 120, such as sending and receiving telemetry, data, instructions, subterranean formation measurements, and other information. Well site controller 107 can also be used to obtain surface readings such as weight on bit, hook load, pressure, torque, flow rate, rate of penetration etc. Computing system 108 can be proximate well site controller 107 or be a distance away, such as in a cloud environment, a data center, a lab, or a corporate office. Computing system 108 can be a laptop, smartphone, PDA, server, desktop computer, cloud computing system, other computing systems, or a combination thereof, that are operable to perform the processes described herein. Well site operators, engineers, and other personnel can send and receive data, instructions, measurements, and other information by various means, now known or later developed, with computing system 108 or well site controller 107. Well site controller 107 or computing system 108 can communicate with downhole tools 120 using various means, now known or later developed, to direct operations of downhole tools 120. The well site controller 107 and/or the computing system 108 can include one or more well operating system that receives a wear condition of the drill bit 122 after the drill bit is pulled from the wellbore 110 and placed on deck 109 in a monitoring apparatus, such as monitoring apparatus 200. The well operating systems can use the wear condition to direct or perform a well operation. For example, a well operating system can be an automated drilling system that receives the wear condition and automatically determines an action for drilling based on the wear condition. The actions, for example, can include: (1) the drill bit is in good condition, has performed well and continue to use for drilling in the wellbore 110; (2) the drill bit is not in good condition, has not performed well, and select another drill bit for drilling in the wellbore 110; or (3) the drill bit is in good condition but select another drill bit to continue drilling based on other factors, such as upcoming type of formation in the drilling path. In a fully automated system, the well operating system can direct the operation of one or more machines or robots to select a new drill bit to use (or determine to use the existing drill bit) and attach the drill bit to the drill pipe for drilling. In other different levels of automation, the well operating system can select the drill bit to use for the bit to be manually loaded or can suggest a drill bit or drill bits to use for manual selection by an operator. Similar levels of automation can also be applied to other downhole tools in addition to a drill bit. The well operating system can be an artificial intelligence (AI) system that uses machine learning, such as reinforcement learning, with wear conditions to determine actions to perform with respect to the downhole tools. For example, historical or old bit gradings can be used (along with those determined automatically) to train a reinforcement learning system to enable at least some automated drilling operations.

FIG. 1 depicts an onshore operations and a specific wellbore configuration. Those skilled in the art will understand that the disclosure is equally well suited for use in offshore operations and is equally well suited for use in wellbores or boreholes having other orientations including vertical boreholes, horizontal boreholes, slanted boreholes, multilateral boreholes, and other borehole types.

Figure 2:
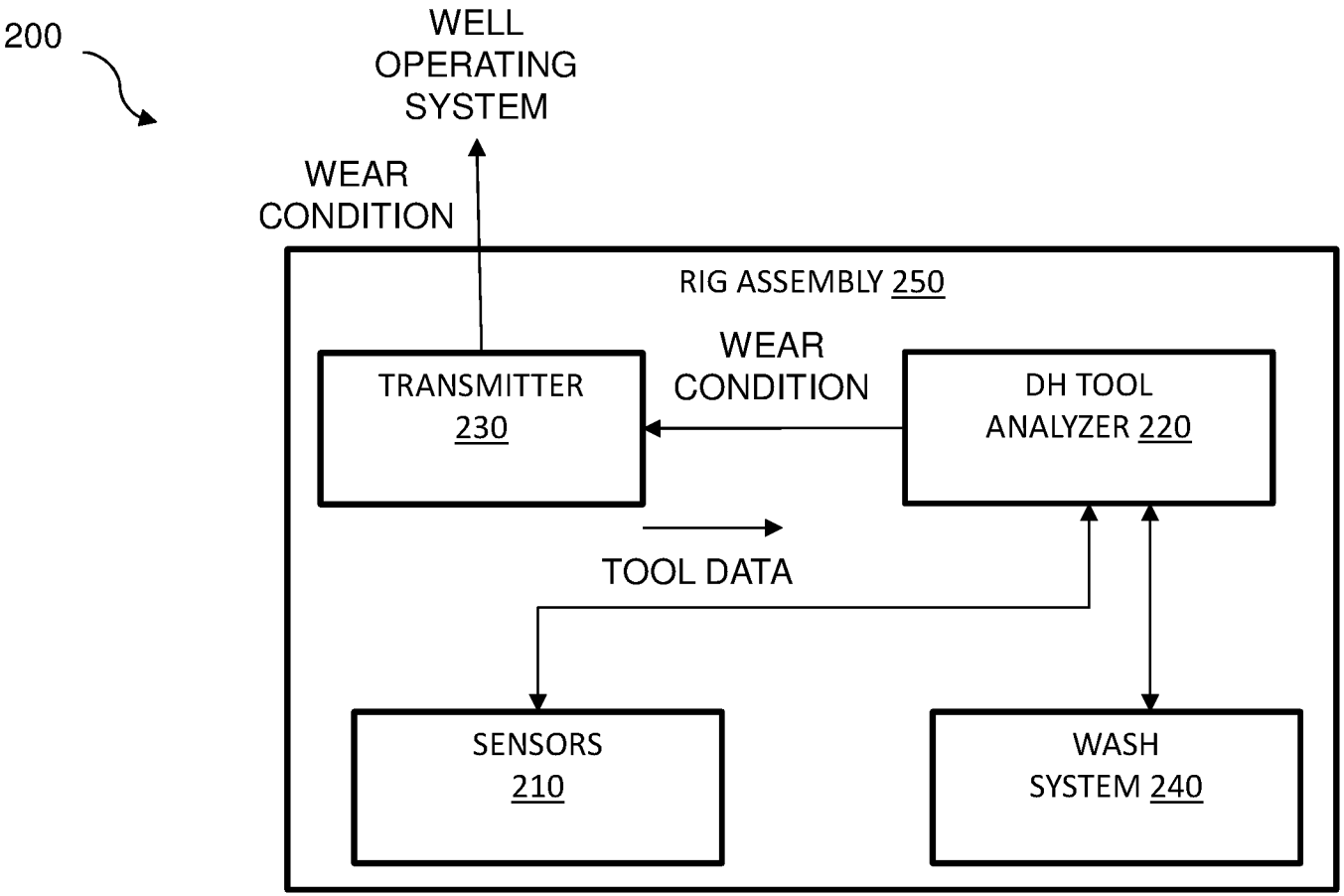
FIG. 2 illustrates a block diagram of an example of a monitoring apparatus constructed according to the principles of the disclosure.

FIG. 2 illustrates a block diagram of an example of a monitoring apparatus 200 constructed according to the principles of the disclosure. The monitoring apparatus 200 includes sensors 210, a downhole tool analyzer 220, a transmitter 230, and a wash system 240. Each of the aforementioned components are associated with a rig assembly 250. The sensor 210, downhole tool analyzer 220, transmitter 230, and wash system 240 can be attached to or embedded with the rig assembly 250. The various components can communicate using protocols standard in the industry or proprietary protocols.

Figure 3:
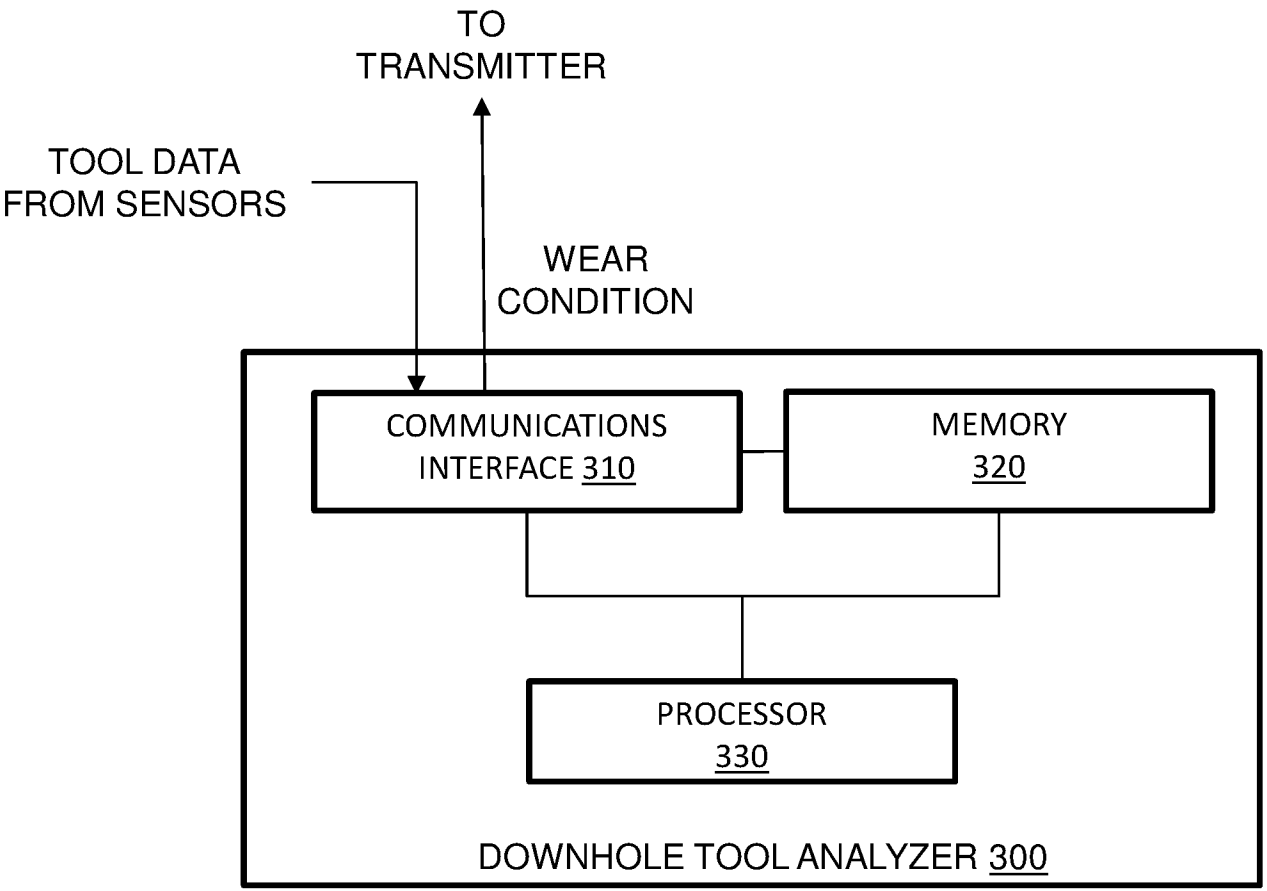
FIG. 3 illustrates a block diagram of an example of a downhole tool analyzer constructed according to the principles of the disclosure.

The sensors 210 are positioned to collect tool data of a downhole tool when secured by the rig assembly 250. The tool data can be surround tool data and will be used in this example. The surround tool data is sent to the downhole tool analyzer 220 for analysis. The downhole tool analyzer 220 includes one or more processors that analyze the surround tool data, which includes a before operation and an after operation set of data, to determine a wear condition of the downhole tool. The downhole tool analyzer 220 can also determine additional information via the analysis, such as possible causes of wear on the downhole tool. The downhole tool analyzer 220 automatically determines the wear condition of the downhole tool in real time based on the surround tool data. The downhole tool analyzer 220 can correlate the processed surround tool data with a known standard in the industry. For example, the downhole tool analyzer 220 can correlate the processed surround tool data with levels of wear of dull bit grading. The downhole tool analyzer 220 can use machine learning, such as reinforcement learning. FIG. 3 provides an example of a downhole tool analyzer for downhole tool analyzer 220.

The downhole tool analyzer 220 sends the wear condition (and other analysis information if available) to the transmitter 230. The transmitter 230 sends the wear condition and possible other analysis information to a well operating system. The well operating system can use the wear condition to execute a well operation. For example, an operator can determine that a drill bit needs to be replaced based on the wear condition before drilling commences. The well operating system can compare the wear condition to an existing model and based thereon adjust coefficients of the model if needed. The model can be based on historical grading of downhole tools, such as dull bit grading. The well operating system can then adjust the model and use the model for Real Time Well Engineering (RTWE) at the wellbore. Accordingly, automatically determined wear conditions can be used with models based on manually determined grading. As such, the electronically determined wear condition can be used to improve a wear model, such as an intelligent Drill Bit to Grading (iDBG) model, and then perform or control a well operation, such as drilling, based on the improved model. The model adjustment and RTWE can be part of an automated well operating system such as the automated drilling operation described above with respect to FIG. 1.

FIG. 3 illustrates a block diagram of an example of a downhole tool analyzer 300 constructed according to the principles of the disclosure. The downhole tool analyzer 300 includes at least one communications interface 310 for receiving and transmitting information, including receiving tool data from sensors of a monitoring apparatus, such as illustrated in FIG. 2. The downhole tool analyzer 300 also includes at least one memory 320 for storing data and computer programs, and at least one processor 330 for performing functions when directed by the computer programs. For example, the memory 320 can be a non-transitory memory that can store code corresponding to algorithms that direct the processor 330 to automatically determine a wear condition of a downhole tool using the tool data according to processes disclosed herein. The stored code can be a computer program product. The one or more processors 330 can be a reinforcement learning system that has been trained using videos, images, data (such as surround data), etc., for automated grading. For example, historical or old bit gradings can be used (along with those determined automatically) to train a reinforcement learning system to automatically determining wear conditions. Video analytics can be used with reinforcement learning for automated grading.

The downhole tool analyzer 300 can be a computing device. The downhole tool analyzer 300 can be a chip, an FPGA, a microcontroller, an ASIC, or another analog or digital processor. The downhole tool analyzer 300 can be within a protective case. The downhole tool analyzer 300 can be mounted/attached to a rig assembly, such as the rig assembly 250 of FIG. 2.

Figure 4:
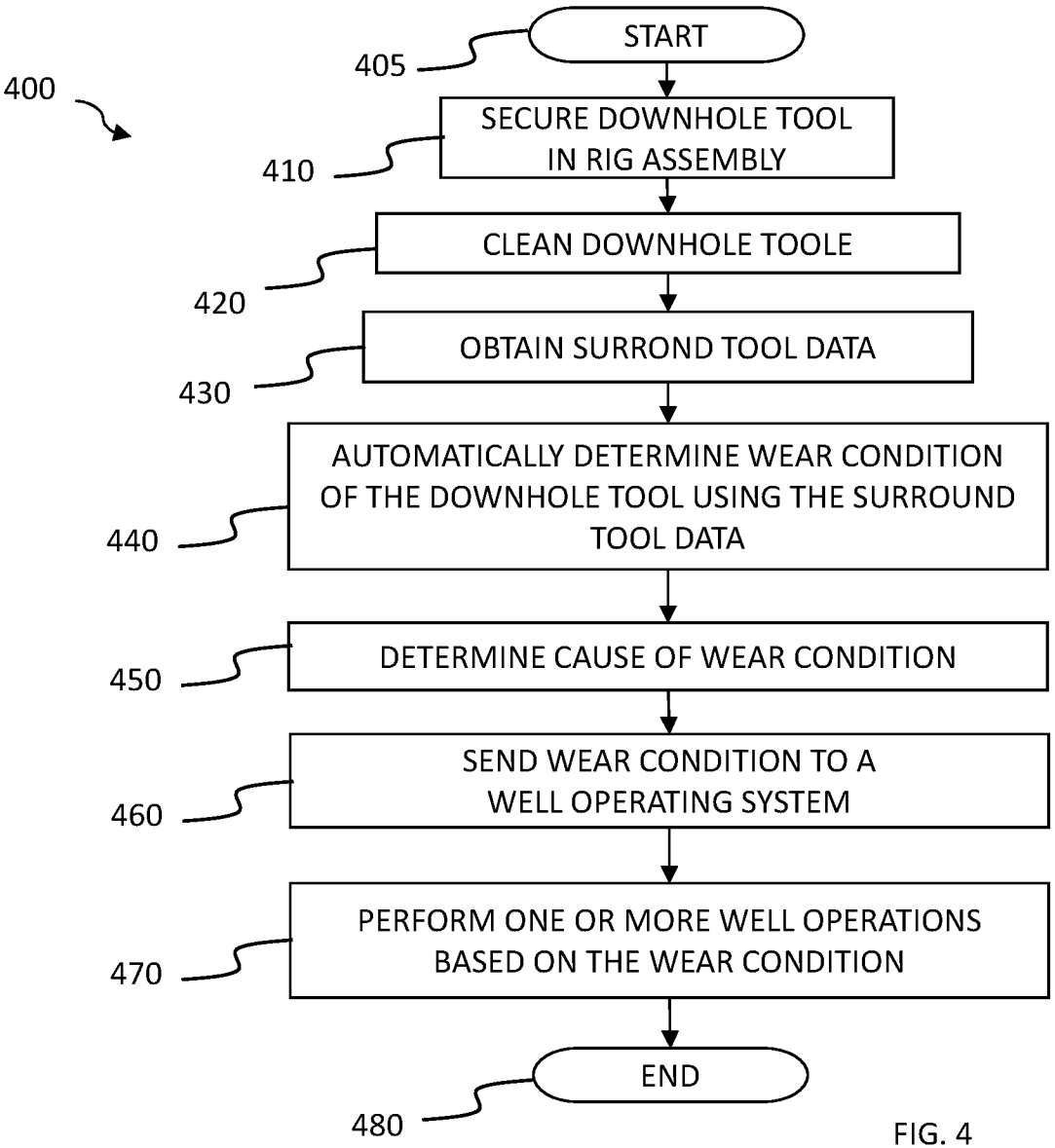
FIG. 4 illustrates a flow diagram of an example method of determining a wear condition of a downhole tool carried out according to the principles of the disclosure.

FIG. 4 illustrates a flow diagram of an example method 400 of determining a wear condition of a downhole tool carried out according to the principles of the disclosure. The wear condition is determined after the downhole tool is used in a downhole operation. Portions of method 400 can use a monitoring apparatus, such as monitoring apparatus 200, which includes a rig assembly and sensors. Additionally, portions of the method can be performed by or directed by a computing device or system, such as downhole tool analyzer 220 or 300 of FIGS. 2 and 3. Method 400 begins in step 405 after tool data, such as surround tool data, of the downhole tool is obtained before the downhole operation.

In step 410, a downhole tool is secured in a rig assembly after being used in a downhole operation. The downhole tool can be a drill bit and the rig assembly can be a bit breaker. The downhole tool can also be another type of tool, such as, mud motors, stablizers, reamers, hole openers, etc. and can include other downhole devices such as tubing. In addition to a bit breaker, the rig assembly can be a mud box, a mud bucket, or another type of tool container used to secure a downhole tool at the surface, such as on deck 109 of FIG. 1. The type of rig assembly may depend on the type of downhole tool.

In step 420, the downhole tool is cleaned. Cleaning of the downhole tool can occur once the downhole tool is secured in the rig assembly. A wash system can be used to clean the downhole tool when in the rig assembly. The wash system can include water jets that provide 360 degrees of cleaning around the downhole tool. The jets can be stationary for the cleaning or can be moved with respect to the downhole tool for cleaning. The jets can be positioned on a circular-frame attached to the rig assembly for the cleaning. The circular-frame can surround or at least partially surround the downhole tool for cleaning. Water can be used with a cleaning solution for cleaning the downhole tool. The wash system can be automatically initiated when the downhole tool is in the rig assembly.

Tool data of the downhole tool in the rig assembly is obtained in step 430 using sensors. The sensors can include, for example, one or more image sensors, one or more lasers, or one or more thermal sensors. The sensors can also include a combination of the different types of sensors. The sensors can be integrated or attached to the rig assembly. One or more of the sensors or different type of sensors can be attached to the downhole tool or can be located downhole. As such, a combination of sensors can be used to gather the tool data. The sensors can provide a comprehensive view of the downhole tool that can include a surround view, such as 360 degrees, along the length of the downhole tool or at least a section of interest of the downhole tool. The same sensors and set-up used to gather the tool data before the downhole operation can also be used to obtain the tool data after the downhole operation. The pre-operation tool data can be considered a first set of tool data and the post-operation tool data can be considered a second set of tool data.

In step 440, a wear condition of the downhole tool is automatically determined by comparing the post-operation tool data to the pre-operation tool data. The wear condition can be automatically determined in real time using visual analytics. One or more algorithms can be used, including functionalities from conventional software, such as facial recognition software, for processing visual data from image sensors. Visual data from multiple cameras can be stitched together to create a surround view for analysis. At least a portion of the analysis can be performed using video analytics and machine learning. You Only Look Once (YOLO) algorithm is an example of an existing algorithm that can be used for determining the wear condition by comparing the pre and post-tool data. Other algorithms can also be used that, for example, use a neural network that is trained using a loss function.

The one or more algorithms may use models developed from data sets trained by historical data for determining the wear condition. For example, the downhole tool can be a drill bit and the wear condition corresponds to a dull bit grading of the drill bit. Libraries of bit dullness data can be incorporated with machine learning in a technique able to identify bit dullness and classify the dullness according to a standard.

The one or more algorithms can use the visual analytics with physics models related to tool data from other sensors for processing. The physics models can be used to check and learn downhole conditions for a given depth in the wellbore.

Method 400 further includes analyzing the tool data and determining causes of the wear condition in step 450. The physics model can be used to assist in determining the causes of the wear condition. Other downhole data and known downhole conditions can also be used in combination with the sensor data for determining the cause of the wear condition. In addition to automatically determining the wear condition, determining causes of the wear condition can also use machine learning. For example, trained data sets and models can be used for determining causes.

Considering the downhole tool being a drill bit, the cause of the wear condition can also be determined based on a drilling efficiency. The drilling efficiency can be determined based on drilling data obtained during the drilling operation, such as rate of penetration (ROP). Data of the subterranean formation, such as type of rock, can also be used for determining the drilling efficiency. The drilling efficiency can be combined with the wear condition to determine the cause or causes.

In step 460, the wear condition is sent to a well operating system. The identified causes, or potential causes, can also be sent to the well operating system. The well operating system can use the wear condition to update model coefficients, adjusts an operating model for the downhole tool, and direct a well operation using the adjusted operating model. For example, a well operating system can be an automated drilling system that receives the wear condition and automatically determines an action for drilling based on the wear condition. The well site controller 107, the computing system 108, or both of FIG. 1 can include one or more well operating system.

In step 470, one or more well operation based on the wear condition is performed. The updated models based on the wear condition can be used to execute the one or more well operations. The well operation can also be executed based on the cause or causes of the wear condition. In step 480 method 400 ends.

The disclosure advantageously discloses comparing visual analytics and images pre and post operation, wherein grading is done electronically and a grade is sent as a report automatically. Examples can evaluate or grade wear or dullness of a downhole tool, such as a drill bit using visual analytics and real-time analysis after the bit is pulled from an operation. The evaluation or grading can compare sensor data obtained before the operation to sensor data after the operation. Using such analytics and analysis, example embodiments can also determine possible causes of the wearing or dulling of the drill bit. Sensors embedded include, for example, sonic or EM which are built in to check integrity of a downhole tool, such as bit/cutter, simultaneously.

A portion of the above-described apparatus, systems or methods may be embodied in or performed by various analog or digital data processors, wherein the processors are programmed or store executable programs of sequences of software instructions to perform one or more of the steps of the methods. A processor may be, for example, a programmable logic device such as a programmable array logic (PAL), a generic array logic (GAL), a field programmable gate arrays (FPGA), or another type of computer processing device (CPD). The software instructions of such programs may represent algorithms and be encoded in machine-executable form on non-transitory digital data storage media, e.g., magnetic or optical disks, random-access memory (RAM), magnetic hard disks, flash memories, and/or read-only memory (ROM), to enable various types of digital data processors or computers to perform one, multiple or all of the steps of one or more of the above-described methods, or functions, systems or apparatuses described herein.

Portions of disclosed examples or embodiments may relate to computer storage products with a non-transitory computer-readable medium that have program code thereon for performing various computer-implemented operations that embody a part of an apparatus, device or carry out the steps of a method set forth herein. Non-transitory used herein refers to all computer-readable media except for transitory, propagating signals. Examples of non-transitory computer-readable media include, but are not limited to: magnetic media such as hard disks, floppy disks, and magnetic tape; optical media such as CD-ROM disks; magneto-optical media such as floppy disks; and hardware devices that are specially configured to store and execute program code, such as ROM and RAM devices. Examples of program code include both machine code, such as produced by a compiler, and files containing higher level code that may be executed by the computer using an interpreter.

In interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

Those skilled in the art to which this application relates will appreciate that other and further additions, deletions, substitutions, and modifications may be made to the described embodiments. It is also to be understood that the terminology used herein is for the purpose of describing particular embodiments only, and is not intended to be limiting, since the scope of the present disclosure will be limited only by the claims. Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, a limited number of the exemplary methods and materials are described herein.

Aspects Disclosed Herein Include:

A. A monitoring apparatus, including: (1) a rig assembly configured to secure a downhole tool at the surface, (2) sensors positioned to collect surround tool data of the downhole tool when secured by the rig assembly, and (3) a downhole tool analyzer having one or more processors configured to automatically determine a wear condition of the downhole tool in real time based on the surround tool data.

B. A method of determining a wear condition of a downhole tool after a downhole operation, including: (1) securing a downhole tool in a rig assembly, (2) obtaining, using sensors, surround tool data of the downhole tool in the rig assembly, wherein the surround tool data includes a first set of surround tool data obtained before a downhole operation by the downhole tool and a second set of surround tool data obtained after the downhole operation, and (3) automatically determining a wear condition of the downhole tool in real time by comparing the second set of surround tool data to the first set of surround tool data.

C. A computing system, comprising: (1) an interface for receiving tool data of a downhole tool, wherein the tool data includes a first set of tool data obtained before a downhole operation by the downhole tool and a second set of tool data obtained after the downhole operation, and (2) one or more processors that perform operations including automatically determining a wear condition of the downhole tool in real time by comparing the second set of tool data to the first set of tool data.

D. A computer program product having a series of operating instructions stored on a non-transitory computer-readable medium that directs a data processing apparatus when executed thereby to perform operations for evaluating properties of a downhole tool, the operations including: (1) obtaining tool data of the downhole tool in a rig assembly, wherein the tool data includes a first set of tool data obtained before a downhole operation by the downhole tool and a second set of tool data obtained after the downhole operation, and (2) automatically determining a wear condition of the downhole tool in real time by comparing the second set of tool data to the first set of tool data.

E. A method including: (1) determining a drilling efficiency of a drill bit used in a drilling operation of a wellbore, (2) performing video analytics of at least one video that includes a rotational view of the drill bit to determine a wear condition of the drill bit after performing the drilling operation in the wellbore, and (3) determining a cause of the wear condition based on the drilling efficiency and the wear condition determined by performing the video analytics.

Each of the disclosed aspects in A, B, C, D, and E can have one or more of the following additional elements in combination. Element 1: wherein the downhole tool is a drill bit. Element 2: wherein the wear condition corresponds to a dull bit grading of the drill bit. Element 3: wherein the one or more processors map the tool data to a level of degradation of the dull bit grading. Element 4: wherein the tool data includes a first set of data obtained before a downhole operation and a second set of data obtained after the downhole operation, and the one or more processors determine the wear condition by comparing the second set of data to the first set of data. Element 5: wherein the sensors include a combination of different types of sensors that obtain the surround tool data. Element 6: wherein the different types of sensors include one or more image sensors, one or more lasers, and one or more thermal sensors. Element 7: further comprising a transmitter configured to transmit the wear condition. Element 8: wherein the transmitter transmits the wear condition to a well operating system that determines one or more actions to perform based on the wear condition, wherein the actions include replace the downhole tool, do not replace the downhole tool, and update a parameter model. Element 9: further comprising a wash system configured to clean the downhole tool when in the rig assembly. Element 10: wherein the wash system includes water jets. Element 11: wherein the downhole tool is a reamer, a hole opener, a mud motor, or a stabilizer. Element 12: wherein the rig assembly is a bit breaker, a mud box, or a tool container. Element 13: further comprising cleaning the downhole tool in the rig assembly after the downhole operation. Element 14: further comprising transmitting the wear condition to a well operating system. Element 15: wherein the well operating system uses the wear condition to update model coefficients, adjusts an operating model for the downhole tool, and direct a well operation using the adjusted operating model. Element 16: further comprising performing a well operation based on the wear condition. Element 17: wherein the sensors include a combination of different types of sensors. Element 18: wherein the different types of sensors include one or more image sensors, one or more lasers, and one or more thermal sensors. Element 19: wherein the downhole tool is a drill bit and the wear condition corresponds to a dull bit grading of the drill bit. Element 20: further comprising analyzing the surround tool data and determining causes of the wear condition based on the analyzing. Element 21: wherein the automatically determining the wear condition and the analyzing the surround tool data uses machine learning. Element 22: wherein the operations further include directing a well operation using the wear condition. Element 23: wherein the tool data is surround tool data. Element 24: wherein the downhole tool is a drill bit and the first and second set of tool data is surround tool data. Element 25: further comprising executing a well operation based on at least one of the wear condition and the cause of the wear condition.

What is claimed is:

1. A monitoring apparatus, comprising:

a rig assembly located on a drilling rig deck and configured to secure a downhole tool at a surface;

a wash system attached to the rig assembly and surrounding the downhole tool, wherein the wash system is configured to clean the downhole tool when secured in the rig assembly located on the drilling rig deck;

sensors configured to collect surround tool data of the downhole tool when secured by the rig assembly; and a downhole tool analyzer having one or more processors configured to automatically determine a wear condition of the downhole tool in real time based on the surround tool data.

2. The apparatus as recited in claim 1, wherein the downhole tool is a drill bit.

3. The apparatus as recited in claim 2, wherein the wear condition corresponds to a dull bit grading of the drill bit.

4. The apparatus as recited in claim 3, wherein the one or more processors map the tool data to a level of degradation of the dull bit grading.

5. The apparatus as recited in claim 1, wherein the tool data includes a first set of data obtained before a downhole operation and a second set of data obtained after the downhole operation, and the one or more processors determine the wear condition by comparing the second set of data to the first set of data.

6. The apparatus as recited in claim 1, wherein the sensors include a combination of different types of sensors that obtain the surround tool data, wherein the different types of sensors include one or more image sensors, one or more lasers, and one or more thermal sensors.

7. The apparatus as recited in claim 1, further comprising a transmitter configured to transmit the wear condition to a well operating system that determines one or more actions to perform based on the wear condition, wherein the actions include replace the downhole tool, do not replace the downhole tool, and update a parameter model.

8. The apparatus as recited in claim 1, wherein the downhole tool is a reamer, a hole opener, a mud motor, or a stabilizer, and the rig assembly is a bit breaker, a mud box, or a tool container.

9. A method of determining a wear condition of a downhole tool after a downhole operation, comprising:

securing a downhole tool in a rig assembly located on a drilling rig deck;

cleaning the downhole tool when secured in the rig assembly located on the drilling rig deck after the downhole operation, wherein the cleaning is performed by a wash system attached to the rig assembly and surrounding the downhole tool;

obtaining, using sensors, surround tool data of the downhole tool in the rig assembly, wherein the surround tool data includes a first set of surround tool data obtained before a downhole operation by the downhole tool and a second set of surround tool data obtained after the downhole operation; and automatically determining a wear condition of the downhole tool in real time by comparing the second set of surround tool data to the first set of surround tool data.

10. The method as recited in claim 9, further comprising adjusting an operating model for the downhole tool by updating coefficients of the operating model using the wear condition, and performing a well operation using the adjusted operating model.

11. The method as recited in claim 9, wherein the sensors include a combination of different types of sensors, wherein the different types of sensors include image sensors, lasers, or thermal sensors.

12. The method as recited in claim 9, wherein the downhole tool is a drill bit and the wear condition corresponds to a dull bit grading of the drill bit.

13. The method as recited in claim 9, further comprising analyzing the surround tool data and determining causes of the wear condition based on the analyzing.

14. The method as recited in claim 13, wherein the automatically determining the wear condition and the analyzing the surround tool data uses machine learning.

15. A computing system, comprising:

an interface for receiving tool data of a downhole tool, wherein the tool data includes a first set of tool data obtained before a downhole operation by the downhole tool and a second set of tool data obtained after the downhole operation; and one or more processors that perform operations including:

automatically determining a wear condition of the downhole tool in real time by comparing the second set of tool data to the first set of tool data, wherein the downhole tool is secured in a rig assembly located on a drilling rig deck when the first or second set of tool data is obtained and cleaned when secured in the rig assembly located on the drilling rig deck, wherein the downhole tool is cleaned using a wash system attached to the rig assembly and surrounding the downhole tool.

16. The computing system as recited in claim 15, wherein the operations further include directing a well operation using the wear condition.

17. The computing system as recited in claim 16, wherein the tool data is surround tool data.

18. A method comprising:

determining a drilling efficiency of a drill bit used in a drilling operation of a wellbore;

performing video analytics of at least one video that includes a rotational view of the drill bit to determine a wear condition of the drill bit after performing the drilling operation in the wellbore; and determining a cause of the wear condition based on the drilling efficiency and the wear condition determined by performing the video analytics, wherein the drill bit is secured in a rig assembly located on a drilling rig deck when the video analytics is performed and cleaned when secured in the rig assembly located on the drilling rig deck, wherein the downhole tool is cleaned using a wash system attached to the rig assembly and surrounding the downhole tool.

19. The method as recited in claim 18, further comprising executing a well operation based on at least one of the wear condition and the cause of the wear condition.

* * * * *